US005692834A

United States Patent [19]

Pagano

[11] Patent Number: 5,692,834

[45] Date of Patent: Dec. 2, 1997

[54] FILM DISPLAY AND MAILER PACKAGE

[75] Inventor: Daniel Michael Pagano, Henrietta, N.Y.

[73] Assignee: Eastman Kodak Company, Rochester, N.Y.

[21] Appl. No.: 704,174

[22] Filed: Aug. 28, 1996

Related U.S. Application Data

[63] Continuation-in-part of Ser. No. 420,256, Apr. 11, 1995, abandoned.

[51] Int. Cl.[6] ..... B65D 27/06; B65D 33/14

[52] U.S. Cl. ..... 383/9; 206/469; 229/70; 229/301; 229/305; 383/61; 383/93; 383/202; 383/204; 383/209

[58] Field of Search ..... 383/9, 202, 204, 383/209, 61, 93, 203; 229/301, 305, 921, 70; 206/469, 806, 831

[56] References Cited

U.S. PATENT DOCUMENTS

| | | | |
|---|---|---|---|
| 1,044,123 | 12/1912 | Berwick | 229/70 |
| 1,173,869 | 2/1916 | Rougeux | 229/305 |
| 1,206,417 | 11/1916 | Cunkle . | |
| 1,568,880 | 1/1926 | Conklin | 229/70 |
| 2,825,498 | 3/1958 | Alves | 229/301 |
| 2,877,944 | 3/1959 | Hyman | 229/72 |
| 2,894,676 | 7/1959 | Lindeke | 229/301 |
| 3,026,019 | 3/1962 | Argabright | 229/72 |
| 3,184,149 | 5/1965 | Repko | 383/203 |
| 3,228,583 | 1/1966 | Dougherty | 383/9 |
| 3,302,861 | 2/1967 | Hiersteiner | 229/70 |
| 3,368,741 | 2/1968 | Mercur | 229/70 |
| 3,472,444 | 10/1969 | Aliff, Jr. et al. | 229/305 |
| 3,506,186 | 4/1970 | Von Clemm | 229/70 |
| 3,942,714 | 3/1976 | Wise | 229/305 |
| 3,968,927 | 7/1976 | Katz et al. | 229/70 |
| 4,066,167 | 1/1978 | Hanna et al. | 383/204 |
| 4,574,951 | 3/1986 | Weaver . | |
| 4,715,531 | 12/1987 | Stewart et al. . | |
| 4,846,504 | 7/1989 | MacGregor et al. . | |
| 5,102,035 | 4/1992 | Cecchi | 229/70 |
| 5,118,031 | 6/1992 | Tighe | 229/301 |
| 5,213,258 | 5/1993 | Kim . | |
| 5,263,586 | 11/1993 | Keable | 206/469 |
| 5,273,361 | 12/1993 | Jillson | 383/93 |
| 5,344,065 | 9/1994 | Moran . | |

FOREIGN PATENT DOCUMENTS

| | | |
|---|---|---|
| 2 620 427 | 3/1989 | France . |
| 2 686 572 | 7/1993 | France . |

*Primary Examiner*—Stephen P. Garbe
*Attorney, Agent, or Firm*—Frank Pincelli

[57] ABSTRACT

A point of sale photographic film package also functions as a non-prepaid mailer to a pre-designated professional film processor. In one embodiment, a film cassette or cartridge is sold in a sealed container, such as an envelope or "bubble pack" card, having a removable label which overlies the name and address of a film processor. The label bears film-identifying indicia on one side thereof and a customer-identifying form on the reverse side. The container further includes (i) indicia or perforations for facilitating access to the film cassette while leaving the container substantially intact for re-use, and (ii) an adhesive strip for resealing the container after the original seal is broken to gain access to the film cassette therein. Upon opening the sealed container and using the film, the customer may have the film processed by returning the exposed film and the container together with the label bearing the completed customer identification form, which includes customer credit information. The container is then resealed and mailed to the processor identified on the container. According to a second embodiment, the film package comprises a sealed reversible pouch which, upon being opened by the customer and turned inside-out, is resealable. One side of the pouch is provided with customer-identifying indicia, while the other side has indicia identifying a professional film processor.

9 Claims, 4 Drawing Sheets

FIG. 5
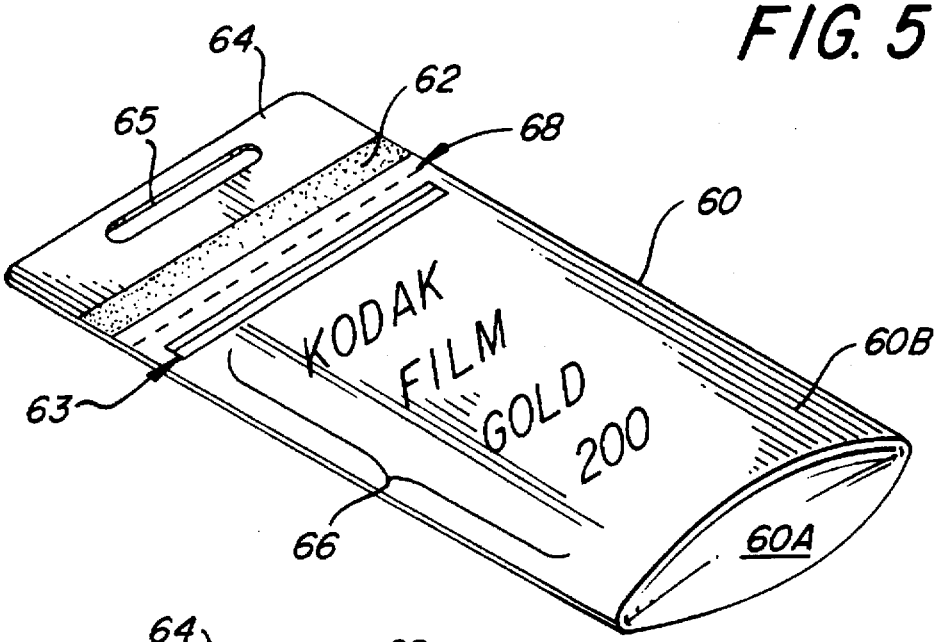
FIG. 6
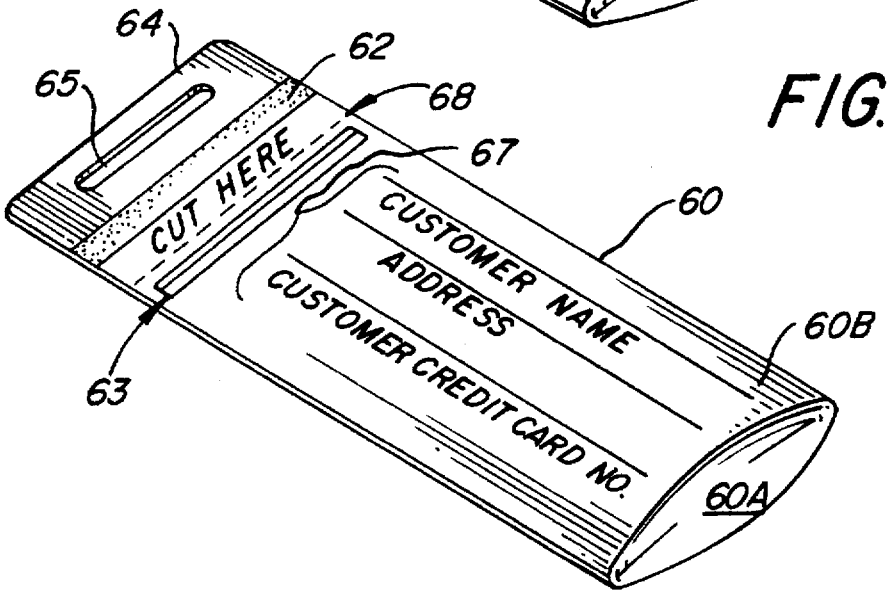
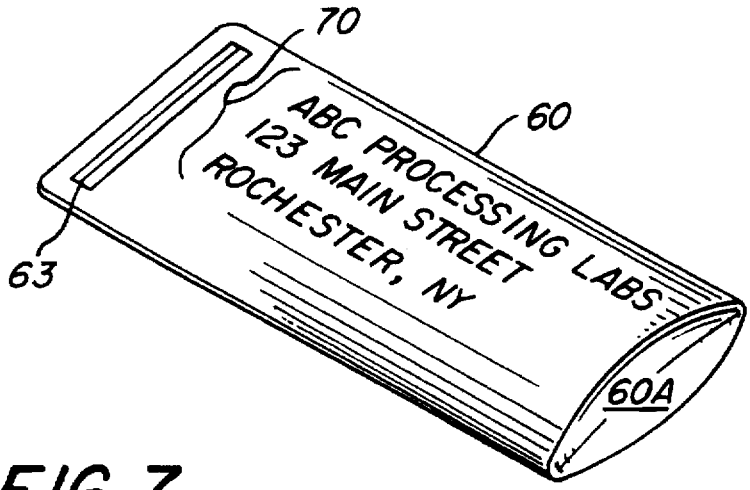
FIG. 7

FILM DISPLAY AND MAILER PACKAGE

CROSS-REFERENCE TO RELATED APPLICATIONS

This is a continuation-in-part of application Ser. No. 08/420,256, filed Apr. 11, 1995, entitled "Film Display/Mailer Package", now abandoned.

BACKGROUND OF THE INVENTION

1. Field of the Invention

The present invention relates to improvements in packages for displaying photographic film for sale. More particularly, it relates to a film display package that can be used as a "mailer" for shipping an exposed film cassette or cartridge to a professional film processor or photo-finisher for subsequent processing.

2. Discussion of the Prior Art

It is common to require users of photographic film products to personally deliver their exposed film cassettes and cartridges to a professional photo-finisher (or his agent) for processing, i.e., development and printing. Added to the inconvenience and expense of such hand delivery is the additional requirement that the customer be available to pick up the processed film (prints or slides) at some later, and often uncertain, time from the photo-finisher. While the results of professional processing are now attainable in a matter of an hour or so, the need to hand deliver and pick-up is viewed by many as a nuisance, especially those who have no need for immediate results or gratification.

Some years ago, "pre-paid film mailers" were introduced by certain film manufactures, e.g., Eastman Kodak Company, to provide the consumer with a more convenient method of having film processed. Such mailers, which are particularly prevalent in countries outside the United States, are in the form of a paper envelope bearing the name and mailing address of a photo-finisher on one side, and a customer mailing address form on the other. The mailer is usually sold together with the film product, and the price paid for the mailer depends upon the number of exposures and type of film contained in the associated film cassette or cartridge. In use, the consumer completes the mailing address form on the mailer, places the exposed film product in the mailer, seals it with an adhesive strip and mails it to the designated photo-finisher. The results are returned to the consumer by mail.

In pre-paid mailers of the type described, there is a problem in crediting the consumer for prints paid for by the consumer but not made by the photo-finisher. For example, if the consumer purchases a mailer entitling him to received 24 prints, and the photo-finisher provides only 20 prints, e.g. because the consumer has made only 20 exposures on the film strip mailed, or because only 20 exposures are printable, the consumer should only be required to pay for the 20 prints received. Credit for the 4 prints paid for but not received is usually handled by a credit slip shipped to the consumer by the photo-finisher with the returned prints. The consumer is then required to use this credit slip in purchasing future mailers.

While the pre-paid film mailer system described above is advantageous in terms of the convenience it offers consumers in having film processed without the concern of personal delivery and pick-up, it may be viewed as disadvantageous at least from the standpoints that (1) the crediting system is somewhat complex and cumbersome, requiring the consumer to save the credit slips and to know how to use them, and (2) the conventional process is not especially environmentally friendly in that the film display container or box must be disposed of and the credit slips must be produced and saved.

SUMMARY OF THE INVENTION

In view of the foregoing discussion, an object of this invention is to provide a film package which functions as both a point of sale display package and a non-prepaid film mailer.

According to a preferred embodiment of the invention, a film display and mailer package comprises (a) a container for releasably containing the product, and (b) a label detachably affixed to the container in a position overlying a region bearing indicia identifying the mailing address of a professional photo-finisher. The container defines a sealed chamber for the product prior to sale and includes (i) means for facilitating the opening of the chamber by a customer to enable the removal of the product therein while leaving the chamber substantially intact, and (ii) means for facilitating the resealing of the chamber after the product has been used and returned to the chamber by the customer. Preferably, the detachable label bears product-identifying indicia on a side thereof exposed for viewing by a prospective customer when the label is affixed to the container, and a customer-identification and credit form on an opposing side thereof which is accessible to the customer for completion upon detaching the label from the container. The label is adapted to be received by the chamber prior to resealing. Preferably, the container comprises a paper envelope or a bubble pack card.

According to another embodiment of the invention, a film display and mailer package comprises a flexible, reversible pouch adapted for use in a normal and inside-out orientations, and sealing means for selectively re-sealing the pouch after it has been opened by the user and turned inside-out. When the pouch is used in a normal orientation, it defines a sealed, moisture-proof chamber for receiving the film product prior to sale and use by the customer. The normally oriented pouch has first, second and third indicia thereon which are visible to the user. The first indicia identifies the product therein, the second indicia indicates a location at which the pouch should be cut open by the customer to gain access to the product therein, and the third indicia provides space for customer information, including mailing address and credit charge information. When the pouch is used in its inside-out orientation, it defines a selectively sealable chamber for receiving the film product upon being used by the customer. The pouch has a fourth indicia thereon which is visible when the pouch is used in its inside-out orientation, such fourth indicia identifying a professional photo-finisher to whom the pouch can be shipped for processing.

As a result of using the film package of the invention, a major portion of the display package is returned to the photo-finisher for eventual re-cycling, and the customer pays only for the number of prints received from the photo-finisher.

The invention and its various advantages will be better understood from the ensuing detailed description of preferred embodiments, reference being made to the accompanying drawings in which like reference characters represent like parts.

BRIEF DESCRIPTION OF PREFERRED EMBODIMENTS

FIGS. 5–7 are perspective views of a further embodiment of the invention in which the film display and mailer package comprises a reversible pouch.

DETAILED DESCRIPTION OF PREFERRED EMBODIMENTS

Figure 1A:
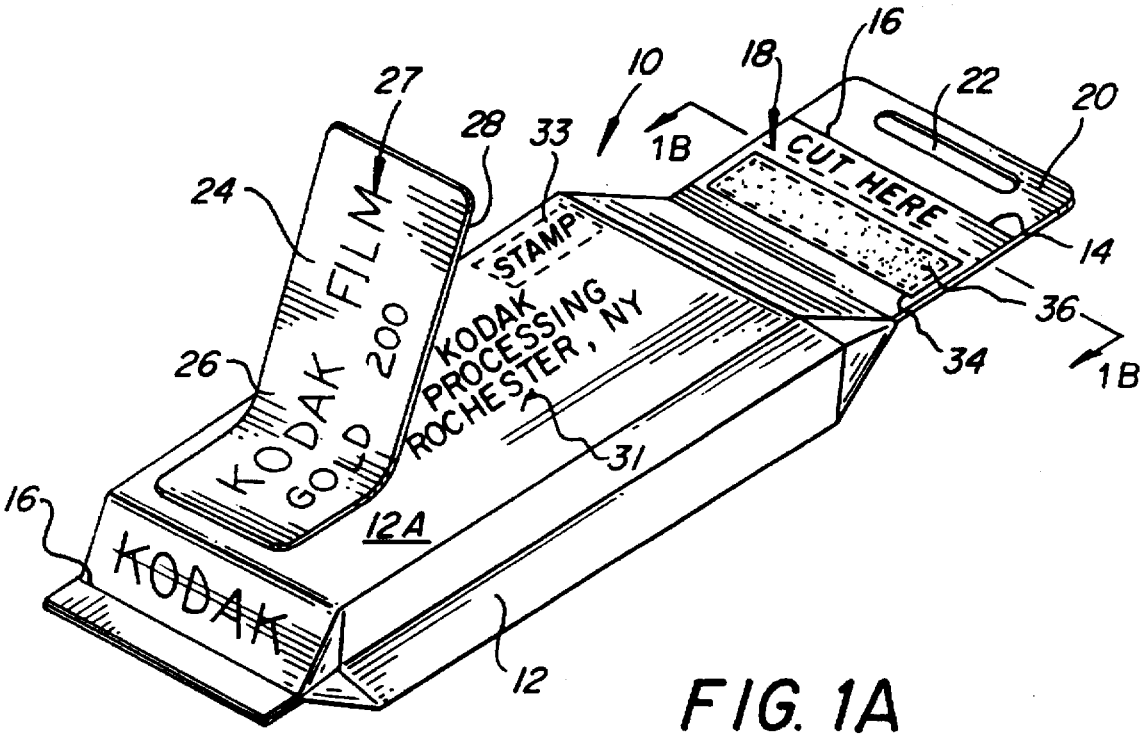
FIG. 1A is a perspective view of a preferred embodiment of the invention in which the film display and mailer package comprises an envelope.
Figure 2:
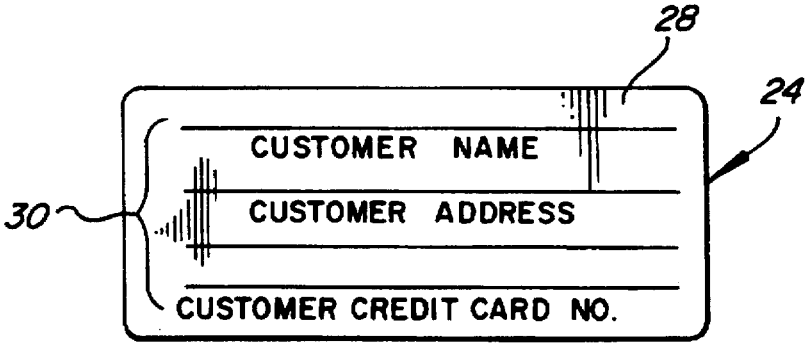
FIG. 2 is a plan view of a detachable label on the envelope of FIG. 1.
Figure 1B:
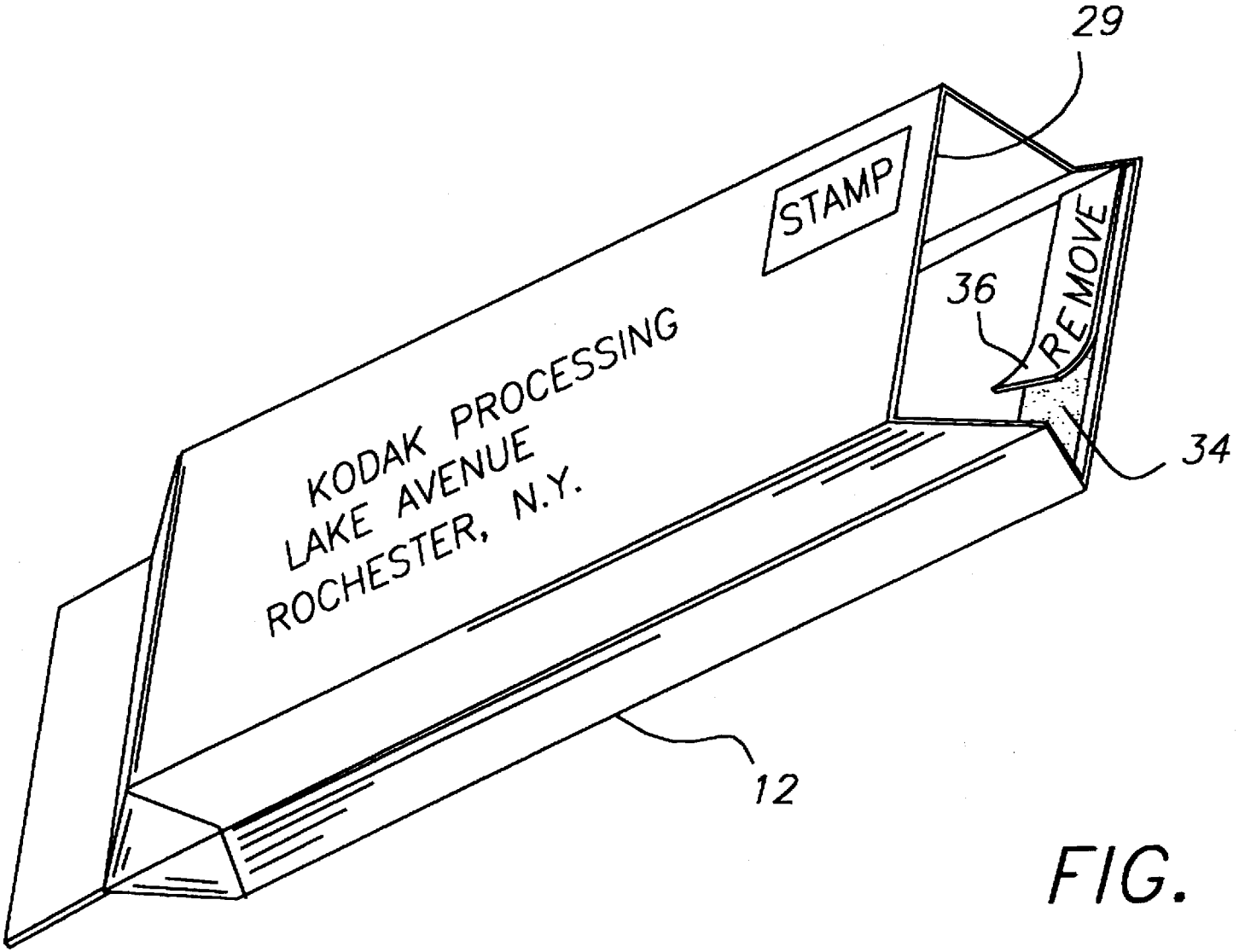
FIG. 1B is a perspective view of the package of FIG. 1A as taken along line 1B—1B after the package has been opened illustrating the means for resealing the envelope.

Referring now to the drawings, FIGS. 1A and 1B illustrate a film package 10 embodying the present invention. The film package comprises an expandable envelope 12 of a size adapted to receive, when expanded to a shape as shown, a conventional film cassette or cartridge, e.g., a 35 mm. cassette or a Size 110 or 126 cartridge. The envelope is preferably made of a moisture-proof material, such as a plasticized paper, and is sealed at both ends along lines 14 and 16 by the film manufacturer after the film cassette or cartridge has been inserted therein. The envelope bears indicia, such as a tear or cut line 18 indicating a location along which the sealed envelope may be broken to gain access to the contents while leaving the major portion of the envelope, especially that portion that contains the film product, intact for subsequent use as a mailer. As shown, the tear line is positioned just inside the seal line 16, i.e., in a direction towards the film-containing portion of the envelope.

Extending from a sealed end of envelope 12 is a display tab 20 having an elongated aperture 22 by which the envelope may be hung from a suitable sales rack for display. A label 24 is detachably affixed to one major surface of the envelope by a suitable releasable adhesive which may cover one entire side of the label or, more preferably, just the peripheral region 25 (as shown by the shaded area) of such side. Alternatively, the adhesive may be provided on the surface 12A of envelope 12. One side 26 of label 24 is provided with indicia 27 identifying the film product within the envelope, and the other side of the label is provided with indicia 30 comprising a form on which the customer can enter his or her mailing address and billing credit information, e.g. a credit card name, number and expiration date. The side 28 is capable of retaining writing placed by typical writing instruments, such as a lead pencil or ink pen. Prior to sale and use by the customer, label 24 is affixed to the envelope in a position overlying indicia 31 on the envelope identifying the mailing address of a professional photo-finisher. Optionally, prepaid postage 33 may be added to the envelope in the region underlying the label.

On the inside of envelope 12 (see FIG. 1B) there is provided an adhesive strip 34 which, prior to use, is protected by a non-stick protective strip 36 which is readily peeled off to access the adhesive strip 34. As shown, the adhesive strip 34 is positioned just inside the tear line 18, i.e., on the inside surface of envelope 12 towards the film-containing portion of the envelope. After the protective strip 36 is removed, the adhesive strip 34 will adhere to the opening side 29 of the inside surface of envelope 12, thereby securing the film container therein.

In use, the film package is displayed for sale as shown in FIG. 1A with the label 24 affixed to the envelope, side 26 and the film-identifying indicia 27 facing the customer. Upon purchasing the film package, the customer opens the sealed package by cutting or tearing it along tear line 18. This step removes tab 20 from the package, and this relatively small portion of the package is the only portion that need be disposed of by the customer. Upon removing and using the film in the envelope, the customer returns the exposed film to the envelope. Label 24 is peeled from the envelope and the customer completes the customer information form 30 on the reverse side. As noted, the required customer information includes billing credit information. The customer encloses the label in the envelope and reseals the envelope by removing protective strip 36 so as to allow adhesive strip 34 to be secured to the opposing side of the envelope, sealing the exposed film cartridge within the envelope 12. Having removed label 24, the photo-finisher's mailing address 31 is visible. The sales package is then mailed to the photo-finisher. Upon processing the film, the photo-finisher debits the credit account of the customer, billing only the amount required for the services rendered. The resulting prints or slides are returned to the customer by mail.

Figure 3:
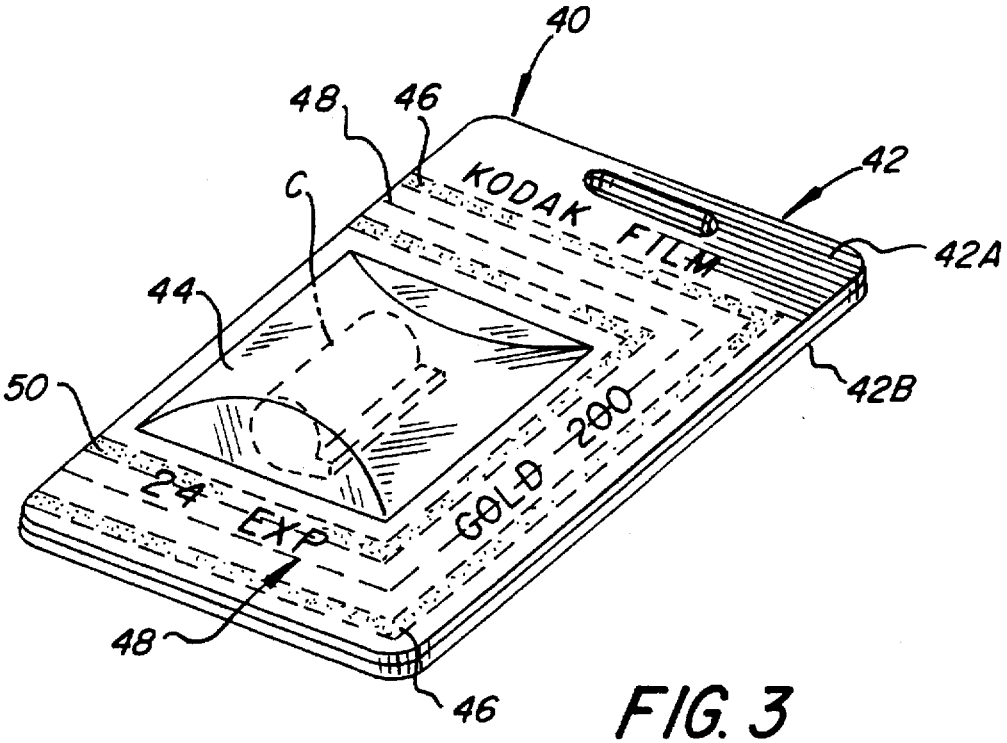
FIGS. 3 and 4 are perspective views of another embodiment of the invention in which the film display and mailer package comprises a bubble pack.
Figure 4:
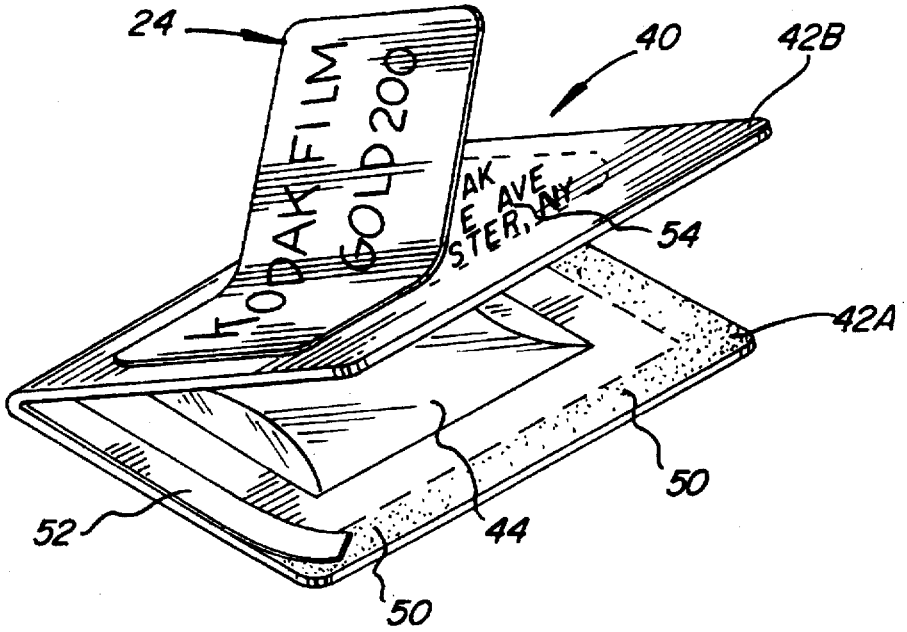

In FIGS. 3 and 4, a variation of the FIG. 1 envelope is shown to comprise a so-called "bubble pack" 40 comprising a folded cardboard card 42 which supports a transparent semi-cylindrical plastic chamber 44 adapted to receive a film cassette or cartridge C. Card 42 is folded in half to define overlapping portions 42A and 42B. Card portion 42A supports the plastic chamber, and card portion 42B provides a top for the chamber when folded to an overlapping position. The film-containing chamber is sealed by the film manufacturer using a suitable adhesive strip 46 to bond the two card portions together. The card bears indicia 48 indicating where the customer should cut or tear the card to gain access to the film therein. Preferably, perforations are formed in the card along the tear line to facilitate opening of the package. A second adhesive strip 50 is applied to the inside of the card, such strip extending substantially parallel to and inside strip 46, i.e., closer to the film chamber. Adhesive strip 50 is normally covered by a peelable protective strip 52. As in the case of the FIG. 1 envelope, card 42 supports a peelable label 24 which bears film-identifying indicia on one side, and a customer-identifying and billing credit information on the other. Preferably underlying label 24 is indicia 54 indicating the mailing address of a photo-finisher.

In use, the customer opens the bubble pack by cutting the card along line 48. Upon exposing the film, the film cartridge is returned to the bubble pack together with label 24 which has been peeled from the card and completed with the customer information. The protective strips 52 are peeled from adhesive strip 50 and the package is resealed. The card is then mailed to the photo-finisher identified on the card portion underlying the label prior to its being peeled from the card.

In FIGS. 5–7, yet another embodiment of the invention is shown as comprising a flexible pouch 60, preferably comprising a pliable but sturdy paper product or plastic. The pouch is adapted for use in "normal" and "inside-out" orientations. In its normal orientation, shown in FIGS. 5 and 6, the pouch defines a sealed chamber containing an unused film cassette (not shown). The base 60A of the pouch is closed, being integral with the endless side wall 60B. The top of the pouch is sealed by an adhesive strip 62. Resealing means 63, such as a "Zip-Lock" brand seal is provided in the vicinity of the adhesive sealing strip 62. It will be noted that the re-sealing means is disposed on the outside of the pouch and, hence, is not useful until the pouch is turned inside-out. An integral display tab 64 extends from the sealed end of the pouch. Tab 64 is provided with a suitable aperture 65 by which the pouch may be hung on a display rack for sale.

In its normal orientation, three different indicia are visible on pouch 60. A first indicia 66 identifies the film product within the pouch, a second indicia 67, preferably located on the reverse side, provides a space for customer mailing address and billing information, and a third indicia 68, located between the sealing strip 62 and the resealing means 63, provides an indication (i.e. a cut line) where there pouch should be cut or torn open to preserve the subsequent utility of the pouch as a sealed mailer. Preferably, perforations are formed in the pouch along the cut line indicia to facilitate opening of the pouch. A fourth indicia 70 is provided on the pouch's "inside" surface, as viewed in its normal orientation. The fourth indicia identifies the mailing address of a professional photo-finisher.

In use, the customer opens the pouch by cutting or tearing along the cut line 68. After exposing the film and completing the customer information required by indicia 67, the customer turns the pouch inside out, thereby exposing the photo-finisher mailing address. In its inside-out orientation, the elements of the resealing means 63 confront each other, such as the male and female components of the Zip-Lock seal. After depositing the exposed film cassette in the pouch, the pouch is re-sealed and mailed to the photo-finisher.

The invention has been disclosed with reference to particularly preferred embodiments. It will be apparent, however, that various modifications and changes can be made without departing from the spirit of the invention, and such modifications and changes are intended to fall within the scope of the appended claims.

LIST OF REFERENCE CHARACTERS

10—film package
12—envelope
14,16—sealed ends
18—"cut" line
20—display tab
22—aperture
24—label
26,28—label sides
27—film identification indicia
30—customer information indicia
31—photo-finisher mailing address indicia
33—postage
34—adhesive strip
36—protective tape for adhesive
40—bubble pack
42—cardboard card
42A,42B—overlapping portions of card
44—plastic chamber
46—adhesive strips
48—cut line indicia
50—adhesive strip
52—peelable protective tape
C—film cassette
60—pouch
60A—pouch base
60B—pouch wall
62—adhesive seal
64—display tab
65—aperture
66—film product indicia
67—customer information form indicia
68—cut line indicia

70—photo-finisher indicia

I claim:

1. A sales display and mailer package for displaying for sale a photographic film product requiring shipment to a professional processor following use by a customer, said sales display and mailer package comprising:

(a) a container for releasably containing said product, said container defining a sealed chamber for said product prior to sale and including (i) means for facilitating the opening of said chamber by providing an access opening to said sealed chamber to enable the removal of the product therein while leaving the chamber substantially intact, and (ii) means for facilitating the sealing of said access opening to chamber after the product has been used and placed in said chamber by the customer, said container having a region identifying the mailing address of a professional processor for said product; and (b) a label detachably affixed to said container in a position overlying said region, said label bearing product-identifying indicia on a side thereof exposed for viewing by a prospective customer when said label is affixed to said container, and customer-identifying form on an opposing side thereof which is accessible to the customer for completion upon detaching said label from said container, said label being adapted to be received by said chamber prior to resealing.

2. The sales display and mailer as defined by claim 1 wherein said container comprises a flexible envelope.

3. The sales display and mailer as defined by claim 2 wherein said means for facilitating the opening of said chamber comprises perforations formed in said envelope.

4. The sales display and mailer as defined by claim 2 wherein said means for facilitating the opening of said chamber comprises indicia identifying a desired cut line along which the envelope can be cut or torn open by the customer so as to form said access opening.

5. The sales display and mailer as defined by claim 3 wherein said envelope comprises an integral tab having a portion defining an aperture by which said envelope can be supported by a display device, and wherein said perforations are located proximate said aperture so that said portion is detached from said envelope when said chamber is opened.

6. The apparatus as defined by claim 4 wherein said envelope comprises an integral tab having a portion defining an aperture by which said envelope can be supported by a display device, and wherein said cut line is located proximate said aperture so that said portion is detached from said envelope when said chamber is opened.

7. The apparatus as defined by claim 1 wherein said label is detachably affixed to said envelope by an adhesive material.

8. The apparatus as defined by claim 1 wherein said adhesive material is disposed in the vicinity of the peripheral region of said opposing side.

9. The apparatus as defined by claim 7 wherein said means for facilitating the sealing of said access opening comprises an adhesive strip placed on the inside surface of said envelope and a removable protective strip placed over said adhesive strip, where said protective strip is removed, said adhesive strip is capable of being secured to the opposing surface for sealing of said opening.

* * * * *